US006062182A

United States Patent [19]

Ogawa

[11] Patent Number: 6,062,182

[45] Date of Patent: May 16, 2000

[54] VALVE TIMING CONTROL DEVICE

[75] Inventor: Kazumi Ogawa, Aichi-ken, Japan

[73] Assignee: Aisin Seiki Kabushiki Kaisha, Aichi-pref., Japan

[21] Appl. No.: 09/201,869

[22] Filed: Nov. 30, 1998

[51] Int. Cl.[7] ..... F01L 1/344

[52] U.S. Cl. ..... 123/90.17; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,775,279 | 7/1998 | Ogawa et al. | 123/90.17 |
| 5,870,983 | 2/1999 | Sato et al. | 123/90.17 |

FOREIGN PATENT DOCUMENTS

| | | |
|---|---|---|
| 1-92504 | 4/1989 | Japan . |
| 9-60507 | 3/1997 | Japan . |
| 9-280017 | 10/1997 | Japan . |

*Primary Examiner*—Weilun Lo

*Attorney, Agent, or Firm*—Reed Smith Hazel & Thomas LLP

[57] ABSTRACT

A valve timing control device comprising a rotor adapted to be fixed on a cam shaft of an engine, a rotational transmitting member mounted around the peripheral surface of the rotor so as to rotate relative thereto within a predetermined range for transmitting a rotational power from a crank shaft, a chamber defined between the rotor and the rotational transmitting member and having first and second circumferentially opposed walls, a vane provided with the rotor and extended outwardly therefrom in the radial direction into the chamber so as to divide the chamber into an advancing chamber and a delaying chamber, the vane being movable between the first and second walls, a locking means for locking between the rotor and the rotational transmitting member at a predetermined relative phase, when the vane is not in contact with either the first or second walls, a first fluid passage for feeding and discharging a fluid to and from the advancing chamber, a second fluid passage for feeding and discharging the fluid to and from the delaying chamber, and a regulating means for making the predetermined relative phase between the rotor and the rotational transmitting member.

7 Claims, 5 Drawing Sheets

VALVE TIMING CONTROL DEVICE

BACKGROUND OF THE INVENTION

1. Field of the Invention

The present invention relates to a valve timing control device and, in particular, to the valve timing control device for controlling an angular phase difference between a crank shaft of a combustion engine and a cam shaft of the combustion engine.

2. Description of the Prior Art

In general, a valve timing of an internal combustion engine is determined by valve mechanisms driven by cam shafts according to either a characteristic or a specification of the internal combustion engine. Since a condition of the combustion is changed in response to the rotational speed of the combustion engine, however, it is difficult to obtain an optimum valve timing through the whole rotational range. Therefore, a valve timing control device which is able to change a valve timing in response to the condition of the internal combustion engine as an auxiliary mechanism of the valve mechanism has been proposed in recent years.

A conventional device of this kind is disclosed, for example, in Unexamined Japanese Patent Publication (Kokai) No. Hei 1-92504. This device includes:

a rotor which is fixed on a cam shaft of an engine, a rotational transmitting member which is mounted around the peripheral surface of the rotor so as to rotate relative thereto within a predetermined range for transmitting a rotational power from a crank shaft, chambers which are defined between the rotor and the rotational transmitting member, wherein each chamber has an advancing side, circumferentially opposed wall and a delaying side, circumferentially opposed wall, vanes which are provided on the rotor and extended outwardly therefrom in the radial direction into the chamber so as to divide the chamber into an advancing chamber and a delaying chamber, wherein the vanes are able to move between the advancing side and delaying side walls, a locking means for locking between the rotor and the rotational transmitting member at a predetermined relative phase, when the vane is in contact with the delaying side walls, first fluid passages for feeding and discharging a fluid to and from the advancing chambers, and second fluid passages for feeding and discharging the fluid to and from the delaying chambers.

In the above prior art device, when the fluid is fed to the advancing chambers via the first fluid passages and is discharged from the delaying chambers via the second fluid passages, the vanes on the rotor rotate in the advancing direction up to contact with the advancing side walls, relative to the rotational transmitting member, such that the valve opening and closing timing is advanced with respect to the crank angle. On the other hand, when the fluid is fed to the delaying chambers and is discharged from the advancing chambers, the vanes on the rotor rotate in the delaying direction up to contact with the delaying side walls, relative to the rotational transmitting member, such that the valve opening and closing timing is delayed with respect to the crank angle.

Further, when the engine is stopped, the fluid source, for example an oil pump, stops delivering the fluid. The fluid in the advancing and delaying chambers is decreased with the lapse of time. Thereafter, when the engine is restarted, there is not enough of the fluid in the chambers to hold the relative phase between the rotor and the rotational transmitting member. Therefore, each of the vanes rotates to the delaying direction and crashes against the delaying side walls of each of the chambers. The crashing sound can be bothersome to a driver and passengers. To avoid the crashing sound, the locking means locks between the rotor and the rotational transmitting member when the vane is in contact with the delaying side walls.

It is known that delaying exhaust valve closing timing makes the engine torque increase when the number of rotations of the engine is large, because fuel and air (the "charge") wants to be sucked into a cylinder of the engine by the inertia of the flow of the charge after a piston starts to move upward.

However, when the above prior art device is used to regulate a cam shaft which opens and closes intake valves, the device sets up the valve closing timing at the most delaying position which is able to suck the charge into the cylinder of the engine when the engine restarts. Therefore, the engine is not able to increase the engine torque when the engine is driven at high speed. On the other hand, if the device sets up the valve closing timing at the most delaying position which is able to increase engine torque when the engine is driven at high speed, restarting the engine is difficult because the inertia of the flow of the charge is small. As a result, although the piston starts to move upward, the intake valves open such that the charge flows in reverse from the cylinder.

In addition, if the above prior art device is used to regulate a cam shaft which opens and closes exhaust valves and the device sets up the valve closing timing at the most delaying timing, the valve overlap period is too long. This increases the amount of exhaust gas recirculation (EGR), thereby degrading the starting performance of the engine.

SUMMARY OF THE INVENTION

Accordingly, it is an object of the present invention to provide an improved valve timing control device without the foregoing drawbacks.

In accordance with the present invention, a valve timing control device comprises a rotor adapted to be fixed on a cam shaft of an engine, a rotational transmitting member mounted around the peripheral surface of the rotor so as to rotate relative thereto within a predetermined range for transmitting a rotational power from a crank shaft, a chamber defined between the rotor and the rotational transmitting member and having first and second circumferentially opposed walls, a vane provided on the rotor and extended outwardly therefrom in the radial direction into the chamber so as to divide the chamber into an advancing chamber and a delaying chamber, the vane being movable between the first and second walls, a locking means for locking between the rotor and the rotational transmitting member at a predetermined relative phase, when the vane is not in contact with either the first or second walls, a first fluid passage for feeding and discharging a fluid to and from the advancing chamber, a second fluid passage for feeding and discharging the fluid to and from the delaying chamber, and a regulating means for regulating the predetermined relative phase between the rotor and the rotational transmitting member.

BRIEF DESCRIPTION OF THE DRAWINGS

The foregoing and additional features of the present invention will become more apparent from the following detailed description of a preferred embodiment thereof when considered with reference to the attached drawings, in which.

DETAILED DESCRIPTION OF THE PREFERRED EMBODIMENT

Figure 1:
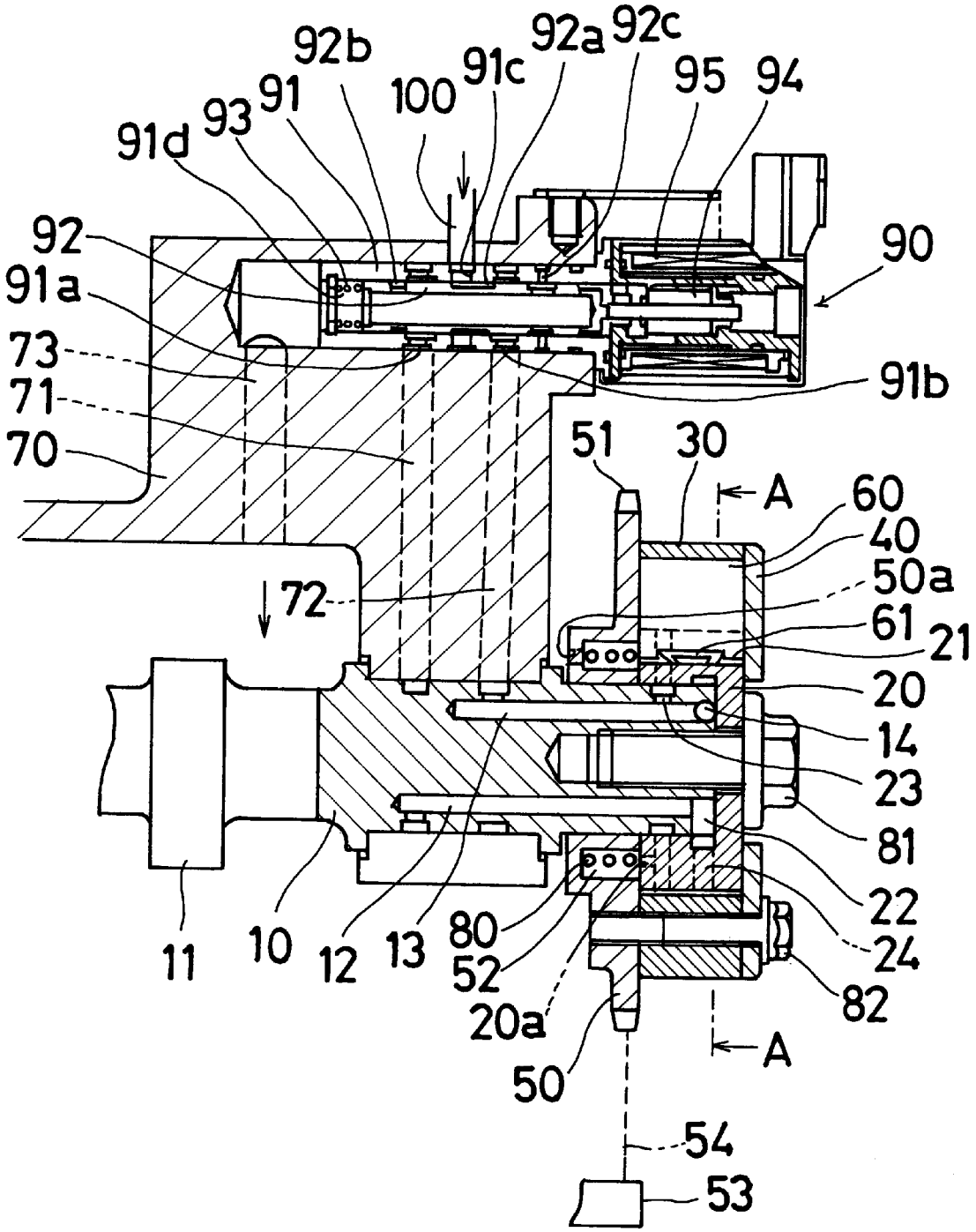
FIG. 1 is a sectional view of the embodiment of a valve timing control device in accordance with the present invention.

A valve timing control device in accordance with a preferred embodiment of the present invention will be described with reference to the attached drawings.

A valve timing control device according to the present invention, as shown in FIGS. 1 to 4, is constructed so as to comprise a valve opening and closing shaft including a cam shaft 10 rotatably supported by a cylinder head 70 of an internal combustion engine, and a rotary shaft which has an internal rotor 20 integrally provided on the leading end portion of the cam shaft 10; a rotational transmitting member mounted around the rotary shaft so as to rotate relative thereto within a predetermined range and including an external rotor 30, a front plate 40, a rear plate 50 and a timing sprocket 51 which is integrally formed around the external rotor 30; five vanes 60 assembled with the internal rotor 20; and a locking means which includes a locking pin 101, the pin 101 is assembled with the external rotor 30. Here, the timing sprocket 51 is constructed, as is well known in the art, to transmit the rotating power to the clockwise direction of FIG. 3 from a crank pulley 53 through a timing chain 54.

The cam shaft 10 is equipped with the well-known cam 11 for opening and closing an exhaust valve (not shown) and is provided therein with an advance passage 12 and a delay passage 13, which are extended in the axial direction of the cam shaft 10. The advance passage 12 is connected to a connection port 91*a* of a housing 91 of a change-over valve 90 via an annular passage and a connection passage 71 which is located within the cylinder head 70. On the other hand, the delay passage 13 is connected to a connection port 91*b* of the housing 91 of the change-over valve 90 via an annular passage and a connection passage 72 which is located within the cylinder head 70. Here, there is a bolt 14 at one end of the delay passage 13 so as to close the end of the passage 13.

Figure 2:
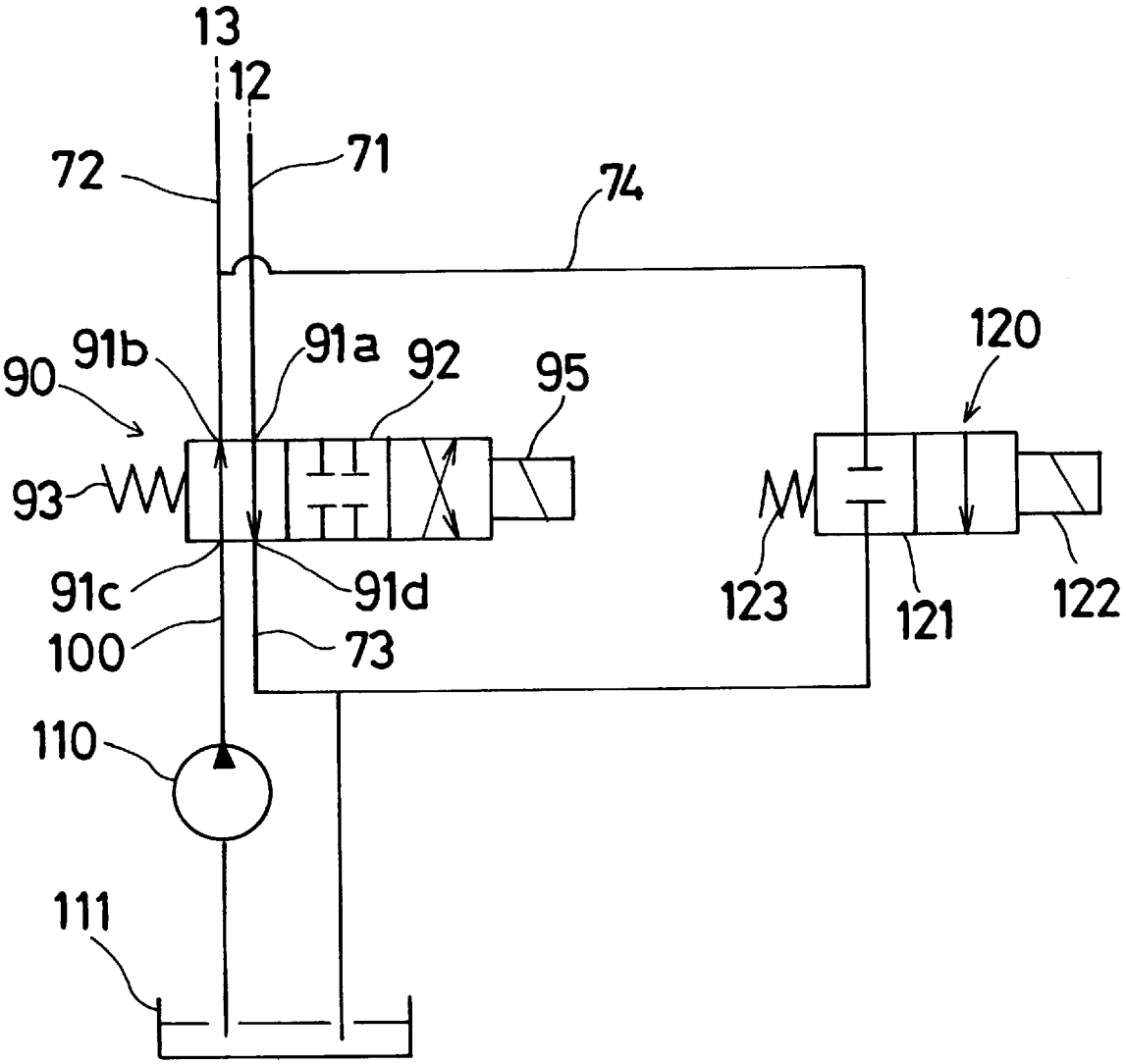
FIG. 2 is a schematic illustration of a control valve and a switching valve of the embodiment shown in FIG. 1 in accordance with the present invention.

The change-over valve 90, as shown in FIGS. 1 and 2, is enabled to move a spool 92 with a moveable core 94 leftward of FIG. 1 against the action of a coil spring 93 by energizing a solenoid 95. The change-over valve 90 is so constructed as to establish, when deenergized, the communication between a feed port 91*c* of the housing 90, as connected to an oil pump 110 to be driven by the internal combustion engine via a feeding passage 100, and the connection port 91*b* via an annular passage 92*a* of the spool and the communication between the connection port 91*a* and an exhaust port 91*d* via a connecting passage 91 of the spool 92 and as to establish, when energized, the communication between the feed port 91*c* and the connection port 91*a* via the annular passage 92*a* and the communication between the connection port 91*b* and an exhaust port 91*d* via a connecting passage 92*c*. As the result, the working oil is fed to the delay passage 13, when the solenoid 95 is deenergized, and to the advance passage 12 when the same is energized. Energizing to the solenoid 95 is duty controlled by a control unit (not shown). Here, the exhaust port 91*d* is connected with an oil pan 111 via an exhaust passage 73 which is located within the cylinder head 70.

As shown in FIG. 2, a by-pass passage 74 is connected between the connection passage 72 and the oil pan 111 so as to bypass the change-over valve 90. There is another change-over valve 120 in the by-pass passage 74. The change-over valve 120 is enabled to move a spool 121 leftward of FIG. 2 against the action of a coil spring 123 by energizing a solenoid 122. When the change-over valve 120 is deenergized, the by-pass passage 74 between the connection passage 72 and the oil pan 111 is closed. When the change-over valve 120 is energized, the by-pass passage 74 between the connection passage 72 and the oil pan 111 is communicated. Energizing to the solenoid 122 is controlled by a control unit (not shown).

The internal rotor 20 is integrally fixed in the cam shaft 10 by means of a bolt 81 and is provided with five axial grooves 21 for providing the five vanes 60 individually in the radial directions. Further the internal rotor 20 is provided with a receiving bore 26 into which a head portion 101*a* of a locking pin 101 is fitted by a predetermined amount when the relative phase between the internal rotor 20 and the external rotor 30 is the predetermined phase (the neutral condition) shown in FIG. 3; a passage 27, which is connected to the advance passage 12, for feeding/discharging the working oil to and from the receiving bore 26; passages 24, which are connected to the advance passage 12, for feeding/discharging the working oil to and from advancing chambers R1; and passages 25, which are connected to the delay passage 13, for feeding/discharging the working oil to and from delaying chambers R2. Here, each vane 60 is urged radially outward by a spring 61 (as shown in FIG. 1) fitted in the bottom portion of the vane groove 21.

The external rotor 30 is mounted on the outer circumference of the internal rotor 20 so as to be able to rotate a predetermined amount relative to the internal rotor 20. As shown in FIG. 1, the front plate 40 and the rear plate 50 are fluid-tightly connected on both sides of the external rotor 30, and the front plate 40, the rear plate 50 and the external rotor 30 are fastened by three bolts 82. The timing sprocket 51 is integrally formed on the outer circumference of the rear end of the external rotor 30. Further, five projecting portions 31 which are projected inwardly are formed on the inner circumferential portion of the external rotor 30. The inner circumferential surface of each projecting portion 31 is slidably mounted on the internal rotor 20. A retracting bore 32 in which the locking pin 101 and a spring 102 are disposed is formed in one of the projecting portions 31.

Each vane 60 is disposed in each pressure chamber R0 formed between the peripheral surface of the rotor 20, the adjacent projecting portions 31 of the external rotor 30, the front plate 40 and the rear plate 50. Further, each vane 60 divides the pressure chamber R0 into the advancing chamber R1 and the delaying chamber R2. In each pressure chamber R0, there are two opposed walls, one is an advance wall 31*a* and the other is a delay wall 31*b*. Each of the vanes 60 is able to move between the advance wall 31*a* and the delay wall 31*b* so as to regulate the rotation range between the internal rotor 20 and the external rotor 30.

The locking pin 101 includes a small diameter portion 101*a* and a large diameter portion 101*b*. The locking pin 101 is fitted in the retracting bore 32 so as to be able to move in the radial direction of the external rotor 30 and is urged toward the internal rotor 20 by the spring 102 which is disposed between the locking pin 101 and a plate-shaped retainer 103. The plate-shaped retainer 103 is fitted into the retracting bore 32 and the one end of the spring 102 is engaged with the retainer 103. Accordingly, the head of the locking pin 80 (that is, the small diameter portion 101*a*) is inserted into the receiving bore 26 so as to lock between the internal rotor 20 and the external rotor 30 at the neutral condition as shown in FIG. 2. In this condition, there is an annular groove 34 between the bottom portion of the retracting bore 32 and the locking pin 101. The annular groove 34 is connected to one of the advancing chambers R1 via a passage 33.

Here, the torque, which needs to rotate the cam shaft 10, is not constant but is variable in proportion to the opening and closing of the intake valves (not shown). In detail, as shown in FIG. 5, the torque is variable periodically between a maximum delaying torque and a maximum advancing torque. When the cam shaft 10 opens the intake valves, the maximum delaying torque occurs so as to urge the cam shaft 10 to rotate in the delaying direction (that is, in the counter-clockwise direction of FIGS. 3 and 4). When the cam shaft 10 closes the intake valves, the maximum advancing torque occurs so as to urge the cam shaft 10 to rotate in the advancing direction (that is, in the clockwise direction of FIGS. 3 and 4). As shown FIG. 5, an absolute valve of the maximum delaying torque is bigger than the same of the maximum advancing torque. Therefore, an average of the torque as shown in the one-dotted line of FIG. 5, is located in the delaying side. Accordingly, when the engine rotates, the torque generally urges the cam shaft 10 to rotate in the delaying direction.

In the above described embodiment, a torsion coil spring 80 causes the internal rotor 20 to relatively rotate against both the external rotor 30, the front plate 40 and the rear plate 50 to the advancing direction as shown in FIG. 1. The urging power of the torsion coil spring 80 is the same as the average of the above torque. The torsion coil spring 80 is located within an annular hollow 52 of the rear plate 50. One end of the torsion coil spring 80 is connected with a connecting hole 50*a* which is located on the bottom portion of the annular hollow 52. The other end of the torsion coil spring 80 is connected with a connecting hole 20*a* which is located on the end surface of the internal rotor 20.

Further, in the above described embodiment, the relative phase between the internal rotor 20 and the external rotor 30 is locked by the locking pin 101, when each of the vanes 60 is at the neutral position in the chamber R0, each vane 60 is not in contact with either the advance wall 31*a* or the delay wall 31*b*. In this condition, the opening and closing timing of the intake valves is able to re-start the engine.

Figure 4:
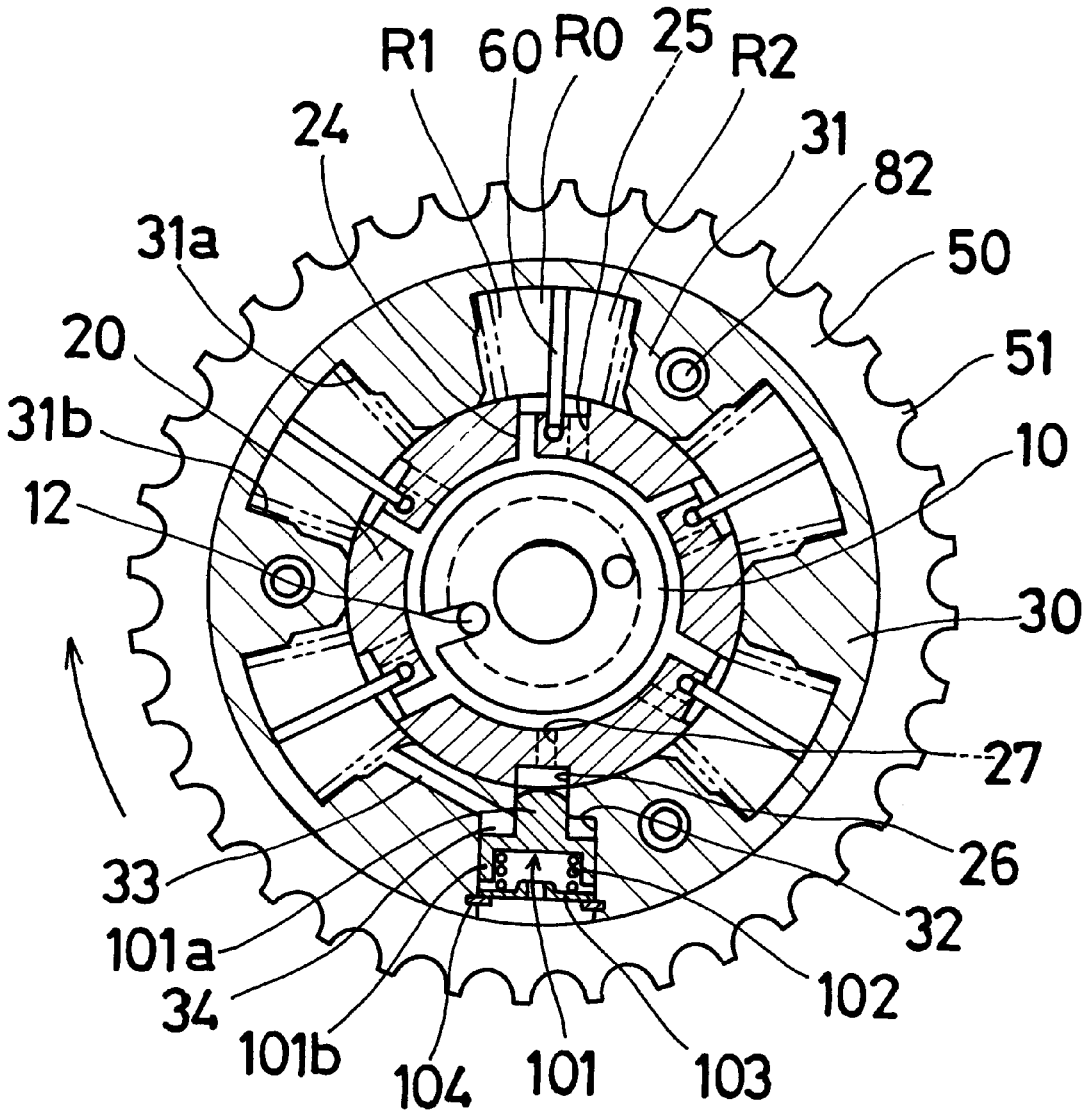
FIG. 4 is a section taken along the line II—II in FIG. 1, when the relative phase is not locked by the locking means in accordance with the present invention.
Figure 5:
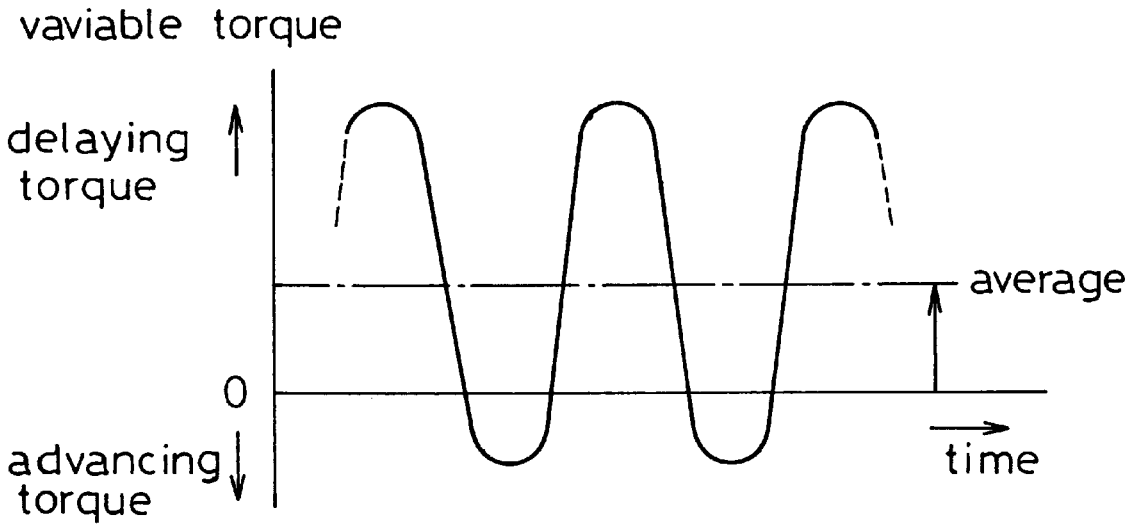
FIG. 5 is a graph showing a fluctuation of torque urging to the cam shaft in accordance with the present invention.

In the above described embodiment of the present invention, in the condition shown in FIG. 4, the engine begins to rotate and the valve timing control device is in the neutral position, and both the advance chambers R1 and the delaying chambers R2 are filled with the predetermined fluid. In detail, in the neutral position, an urging power to rotate the vanes 60 with the internal rotor 20 and the cam shaft 10 to the advance direction by the fluid within each advancing chamber R1 and by the torsion coil spring 80 corresponds to an urging power to rotate the same to the delay direction by the fluid within each delaying chamber R2 and the average of the variable torque. If the duty ratio to supply the electric current with the solenoid 95 of the change-over valve 90 becomes large in the neutral condition, the fluid is fed to each of the advancing chambers R1 via the advance passage 12 and the passages 24, and is discharged from each of the delaying chambers R2 via the passages 25 and the delay passage 13. As a result, the vanes 60 and the internal rotor 20 with the cam shaft 10 is relative rotated to the external rotor 30 in the advance direction that is clockwise direction of FIG. 4. The relative rotation is stopped at the maximum advanced condition that the vanes 60 contact with the advance wall 31*a* that shown the one dotted line of FIG. 4. On the other hand, if the duty ratio to supply the electric current with the solenoid 95 of the change-over valve 90 becomes small in the neutral condition, the fluid is discharged from each of the advancing chambers R1 via the advance passage 12 and the passages 24, and is fed to each of the delaying chambers R2 via the passages 25 and the delay passage 13. As a result, the vanes 60 and the internal rotor 20 with the cam shaft 10 is relatively rotated to the external rotor 30 in the delay direction (that is, in the counter-clockwise direction of FIG. 4). The relative rotation is stopped at the maximum delayed condition that the vanes 60 contact with the delay wall 31*b* as shown in the two-dotted line of FIG. 4. Here, when the vanes 60 and the internal rotor 20 rotate, either the receiving bore 26 or the annular groove 34 is fed the fluid via the passage 27 or the passage 33 such that the locking pin 101 moves against the action of the spring 102 and the head portion 101*a* of the locking pin 101 is received in the retracting bore 32. Further, in the above rotation of the vanes 60 and the internal rotor 20, the solenoid 122 of the change-over valve 120 is deenergized such that the communication between the connection passage 72 and the oil pan 111 is closed.

Figure 3:
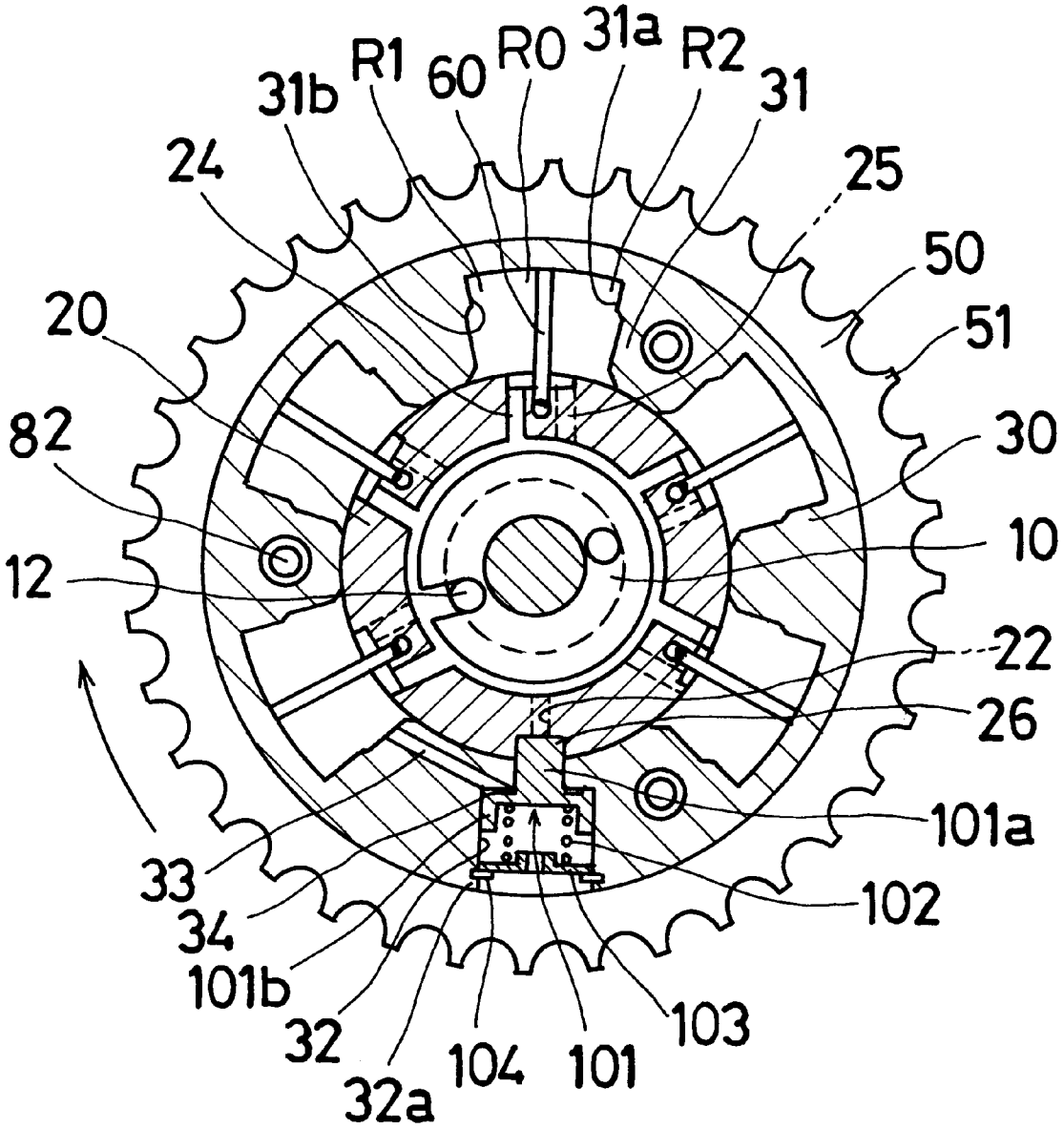
FIG. 3 is a section taken along the line II—II in FIG. 1, when the relative phase is locked by the locking means in accordance with the present invention.

In this embodiment as shown in FIGS. 3 and 4, when each vane 60 is at the neutral position in the chamber R0, the head portion 101*a* is inserted into the receiving bore 26 so as to lock the relative phase between the internal rotor 20 and the external rotor 30 and to be able to re-start the engine. Accordingly, the valve timing control device is further able to rotate the internal rotor 20 with the cam shaft to the delaying direction from the neutral condition such that the device is able to delay the closing timing of the intake valves. As a result, the charge sucks into a cylinder of the engine by the inertia of the flow of the charge such that the engine torque is able to increase when the number of rotations of the engine is large.

When the engine stops, the oil pump 110 stops to feed the fluid to the chambers RO and the solenoid 95 of the change-over valve 90 is deenergized. Therefore, neither the urging power of the fluid in the advancing chambers R1 nor the urging power of the fluid in the delaying chambers R2 act on the vanes 60 with the internal rotor 20 and the cam shaft 10, but the urging powers of the torsion coil spring 80 and the average of the above variable torque (until the rotation of the crank shaft 53 of the engine is a complete stop) act on the same members. Accordingly, the relative phase between the internal rotor 20 and the external rotor 30 at the stop of the engine is decided in proportion to the relative phase therebetween at the timing just before the stop of the engine. If the relative phase between the internal rotor 20 and the external rotor 30 is a predetermined position that both the retracting bore 32 and the receiving bore 26 face each other, the head portion lOla of the locking pin 101 is inserted into the receiving bore 26 by the action of the spring 102, as shown in FIG. 3, such that the relative phase is locked. If the relative phase is in a position that is between the predetermined position and the maximum advanced condition, the internal rotor 20 and the cam shaft 10 are relatively rotated to delay direction against the external rotor 30 by the above variable torque when the direction of the variable torque is to the delay direction. Thereafter, when the relative phase is the predetermined position, the head portion 101*a* is inserted into the receiving bore 26 by the action of the spring 102 such that the relative phase is locked. Here, for a period from the engine stop timing to the timing that the rotation of the crank shaft 53 of the engine is a complete stop, the variable torque shown in FIG. 5 acts on the cam shaft 10 and the oil pump 110 is rotated. The internal rotor 20 and the cam shaft 10 are relatively rotated to the delay direction against the external rotor 30, because the solenoid 95 of the change-over valve 90 is deenergized. In detail, in the above period, the change-over valve 90 makes the communication between the delay passage 13 and the oil pump 110 which is rotating such that the fluid feeds to the delaying chambers R2. The change-over valve further makes the communication between the advance passage 12 and the oil pan 111 such that the fluid discharges from the advancing chambers R1. Further, the rotational speed of the internal rotor 20 and the cam shaft 10 can be slow so as to facilitate insertion of the head portion 101*a* of the locking pin 101 into the receiving bore 26, because the torsion coil spring 80 urges to the advance direction such that the maximum delaying torque of the variable torque becomes small.

In this embodiment, a starter switch (not shown) turns on at the re-start of the engine, the solenoid 122 of the change-over valve 120 is energized for a predetermined period such that the connection passage 72, which connects with the delay passage 13, is connected with the oil pan 111. Therefore, both the advancing chamber Ri and the delaying chamber R2 are connected with the oil pan 111, because the solenoid 95 of the change-over valve 90 is deenergized at the re-start of the engine. Accordingly, the internal rotor 20 is fluttered to the advance side and the delay side by the action of the torsion coil spring 80 and the variable torque. In this time, because the head portion 101*a* of the locking pin 101 inserts into the receiving bore 26, flutter of the internal rotor 20 is prevented.

On the other hand, if the relative phase is in a position that is between the predetermined position and the maximum delayed condition at just before the engine stop, the head portion 101*a* of the locking pin 101 does not insert into the receiving bore 26. When the engine re-starts in this condition, there is little possibility that re-starting the engine will be difficult because the internal rotor 20 and the cam shaft 10 are relatively rotated to the maximum delayed condition against the external rotor 30 by the variable torque which acts on the cam shaft 10. However, in this embodiment, both the advancing chambers R1 and the delaying chambers R2 are connected with the oil pan 111 so as to flutter the internal rotor 20 on both the advance side and the delay side. Further, the torsion coil spring 80 urges the internal rotor 20 to the advance direction such that a fluttered distance to the advance side is long. Accordingly, the relative phase between the internal rotor 20 and the external rotor 30 is in the predetermined position such that both the retracting bore 32 and the receiving bore 26 face each other and the head portion 101*a* of the locking pin 101 can be inserted into the receiving bore 26 so as to prevent fluttering of the internal rotor 20.

As a result, when the engine is re-started, non-necessary relative rotation between the rotational shaft comprising the cam shaft 10, the internal rotor 20, the vanes 60 and so on and the rotational transmitting member comprising the external rotor 30, the front plate 40, the rear plate 50 and so on due to the large rotational variation is regulated and the drawback due to the unnecessary relative rotation between the rotational shaft and the rotational transmitting member (for example, collision noise by the vanes 60) is avoided. In addition, in the above embodiment, the collision noise is avoided when the engine starts, and the engine torque is increased when the number of rotations of the engine is large.

In this embodiment, each vane 60 contacts with the advance wall 31*a* and the delay wall 31*b*. However, in another embodiment that includes some vanes, only one vane contacts with the advance wall and the delay wall and the others do not contact the walls. In this embodiment, the vanes 60 and the internal rotor 20 are separate parts. In a still further embodiment, some vanes and an internal rotor form an integral structure. In this embodiment, the receiving bore 26 and the retracting bore 32 are located in the radial direction of the cam shaft 10. In yet a further embodiment, a receiving bore and a retracting bore are located in the axial direction of a cam shaft. In detail, one of the receiving bore and the retracting bore is disposed within a rotational shaft (for example a vane), and the other is disposed within a rotational transmitting member (for example a front plate or a rear plate).

In the aforementioned embodiment, on the other hand, the valve timing control device is assembled with the cam shaft 10 for the intake valves. However, the invention can likewise be practiced by a valve timing control device to be assembled with the cam shaft 10 for exhaust valves.

While the invention has been described in detail and with reference to specific embodiments thereof, it will be apparent to one skilled in the art that various changes and modifications can be made therein without departing from the spirit and scope thereof.

What is claimed is:

1. A valve timing control device comprising:

a rotor adapted to be fixed on a cam shaft of an engine;

a rotational transmitting member mounted around the peripheral surface of the rotor so as to rotate relative thereto within a predetermined range for transmitting a rotational power from a crank shaft;

a chamber defined between the rotor and the rotational transmitting member and having first and second circumferentially opposed walls;

a vane provided with the rotor and extended outwardly therefrom in the radial direction into the chamber so as to divide the chamber into an advancing chamber and a delaying chamber, the vane being movable between the first and second walls;

a locking means for locking between the rotor and the rotational transmitting member at a predetermined relative phase, when the vane is not in contact with either the first or second walls;

a first fluid passage for feeding and discharging a fluid to and from the advancing chamber;

a second fluid passage for feeding and discharging the fluid to and from the delaying chamber; and a regulating means for making the predetermined relative phase between the rotor and the rotational transmitting member.

2. A valve timing control device in claim 1, wherein the locking means comprises:

a refuge hole formed in one of the rotor and the rotational transmitting member for accommodating therein a locking pin spring-biased toward the other of the rotational transmitting member and the rotor;

a fitting hole formed in the other one of the rotational transmitting member and the rotor for fitting therein a head portion of the locking pin when the rotor and the rotational transmitting member are synchronized in the predetermined relative phase; and a feeding means for feeding the fluid to the locking pin so as to pull out the head portion of the locking pin from the fitting hole.

3. A valve timing control device in claim 2, wherein the feeding means communicates with one of the first and second fluid passages.

4. A valve timing control device in claim 2, wherein the regulating means comprise a force member which urges the rotor in the advancing direction relative to the rotational transmitting member.

5. A valve timing control device in claim 4, wherein the force member is a coil spring.

6. A valve timing control device in claim 2, further comprising a fluid regulating means for discharging the fluid from both of the advancing and delaying chambers, when the engine re-starts.

7. A valve timing control device in claim 6, the fluid regulating means include two change-over valves that one controls the first fluid passage and the other controls the second fluid passage.

* * * * *

UNITED STATES PATENT AND TRADEMARK OFFICE

CERTIFICATE OF CORRECTION

PATENT NO. : 6,062,182
DATED : May 16, 2000
INVENTOR(S) : Ogawa

It is certified that error appears in the above-identified patent and that said Letters Patent is hereby corrected as shown below:

On the title page:

Item [30 ], please insert --Foreign Application Priority Data
November 28, 1997 [JAPAN] 9-327732

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*